US007689342B2

(12) United States Patent
Suzuki et al.

(10) Patent No.: US 7,689,342 B2
(45) Date of Patent: Mar. 30, 2010

(54) COMPACTION VEHICLE

(75) Inventors: Sadayoshi Suzuki, Saitama (JP); Isamu Miyamoto, Saitama (JP); Shinnosuke Tanaka, Kanagawa (JP)

(73) Assignee: Sakai Heavy Industries Ltd., Tokyo (JP)

( * ) Notice: Subject to any disclaimer, the term of this patent is extended or adjusted under 35 U.S.C. 154(b) by 289 days.

(21) Appl. No.: 11/499,914

(22) Filed: Aug. 4, 2006

(65) Prior Publication Data

US 2007/0032934 A1 Feb. 8, 2007

(30) Foreign Application Priority Data

Aug. 5, 2005 (JP) ..... 2005-227807

(51) Int. Cl.
*B60T 8/32* (2006.01)
*G06F 19/00* (2006.01)
*B60K 31/00* (2006.01)

(52) U.S. Cl. ..... 701/93; 701/1; 701/50; 701/97; 701/98; 180/170; 180/174

(58) Field of Classification Search ..... 701/1, 701/50, 93, 97, 98; 180/170, 174
See application file for complete search history.

(56) References Cited

U.S. PATENT DOCUMENTS 5,916,291 A * 6/1999 McKee ..... 701/55
6,009,367 A * 12/1999 Hori et al. ..... 701/93
6,138,071 A * 10/2000 Sekine et al. ..... 701/93
6,655,233 B2 * 12/2003 Evans et al. ..... 74/731.1
6,688,418 B2 * 2/2004 Bohrer ..... 180/305
6,704,637 B1 * 3/2004 Hrazdera et al. ..... 701/93
6,851,495 B2 * 2/2005 Sprinkle et al. ..... 180/53.2
6,853,903 B2 * 2/2005 Michi et al. ..... 701/93
2003/0047003 A1 * 3/2003 Miyamoto et al. ..... 73/660

FOREIGN PATENT DOCUMENTS

JP 2001-342609 12/2001

* cited by examiner

*Primary Examiner*—Jack W. Keith
*Assistant Examiner*—Chuong P Nguyen
(74) *Attorney, Agent, or Firm*—Carrier, Blackman & Associates, P.C.; Joseph P. Carrier; William D. Blackman

(57) ABSTRACT

The compaction vehicle having a speed adjustment member, a displacement detector, and a drive source controller further includes a calculation device between the displacement detector and the drive source controller, receiving the displacement S, and outputting a signal I calculated to the controller; a running speed setting switch for the operator operating ON at a desired running speed; a control signal memory device provided inside the calculation device and memorizing a signal I1 to the controller, wherein in a normal operation the calculation device outputs the signal I to the controller so that a running speed increases or decreases according to the displacement S, and wherein when the switch is operated to ON, the calculation device maintains the ON state, and the displacement S is not less than a predetermined value, the calculation device outputs the signal I1 memorized in the memory device so as to run the vehicle at a constant speed.

10 Claims, 5 Drawing Sheets

COMPACTION VEHICLE

BACKGROUND OF THE INVENTION

1. Field of the Invention

The present invention relates to a compaction vehicle used in such a compaction construction of a road surface.

2. Description of the Related Art

A compaction vehicle (for example, see FIG. 1 of Japanese Patent Laid-Open Publication No. 2002-342609) such as a compaction roller and a vibrating roller compacts a road surface by a compaction wheel, repeatedly moving forward and backward at a comparatively low speed. In a compaction construction by compaction vehicle, although there is a case that a vehicle running speed is made different according to such a kind of road surface material (such a kind of asphalt composite material), a temperature of the road surface material, an outside air temperature, a kind of vehicle, and a construction condition, a important matter in any running speed is to run the vehicle at a constant speed so that no variation occurs in a compaction density of the road surface.

Normally, near a driver's seat of a compaction vehicle is provided a forward/backward lever with which the vehicle stops running at a neutral position, moves forward if tilting the lever forward from the neutral position, and moves backward if tilting the lever backward. A running speed is adjusted by the forward/backward lever, and in proportion to a tilting angle from the neutral point, the running speed is designed to increase. Accordingly, in order to run the vehicle at an arbitrary speed, the forward/backward lever is shifted at an appropriate position.

In running a compaction vehicle at a constant speed, in case of only a moving forward or backward, there is no problem because it suffices to once shift a forward/backward lever to an appropriate tilting position as described before. However, because there is a need for repeatedly moving the compaction vehicle in a normal compaction construction as described before, it is necessary in this case for an operator to accurately stop the forward/backward lever again and again at a predetermined tilting position of a forward side and that of a backward side in order to run the vehicle at a constant speed. This accurate lever operation is difficult even for a skilled operator, and it can be said that a strict constant running is extremely difficult in effect.

Consequently, there is a need for a compaction vehicle that can be easily driven at a constant speed even in a case of repeatedly moving forward and backward.

SUMMARY OF THE INVENTION

In order to solve the problem, in a compaction vehicle having a speed adjustment member provided near a driver's seat for an operator running and stopping the vehicle and capable of adjusting a running speed, a displacement detection device for detecting a displacement S from a stop operation position of the speed adjustment member, and a drive source controller for controlling a running drive source, the present invention is the compaction vehicle comprising: a calculation device existing between the displacement detection device and the drive source controller, receiving the displacement S, and outputting a calculated signal I to the drive source controller; a running speed setting switch for the operator operating ON at a desired running speed; a control signal memory device provided inside the calculation device and memorizing a signal I1 to the drive source controller which the signal I1 is generated when the running speed setting switch is operated to ON, wherein in a normal operation the calculation device outputs the signal I to the drive source controller so that a running speed increases or decreases according to an increase or decrease of the displacement S, wherein when the running speed setting switch is operated to ON, the calculation device maintains the ON state, and the displacement S is not less than a predetermined value, the calculation device outputs the signal I1 memorized in the control signal memory device so as to run the vehicle at a constant speed.

In accordance with the compaction vehicle it is possible to easily and surely run a compaction vehicle at a constant speed in a compaction construction.

Furthermore, the present invention is a compaction vehicle, wherein the calculation device comprises a displacement memory device configured to memorize a displacement S1 generated when the running speed setting switch is operated to ON, and a comparison device configured to compare the displacement S with the displacement S1 memorized in the displacement memory device when the running speed setting switch is operated to ON and is in the ON state, and wherein when the running speed setting switch is operated to ON, the calculation device maintains the ON state, and the displacement S≧the displacement S1 is satisfied, the calculation device outputs the signal I1 memorized in the control signal memory device so as to run the vehicle at a constant speed in the displacement S1.

In accordance with the compaction vehicle, because in an operator an operability of a speed adjustment member is not at all different from the operability in a normal operation until the vehicle reaches a constant speed, there also occurs no problem of a vehicle sudden start and stop possible to be caused due to, for example, the change of the operability.

Furthermore, in a compaction vehicle having a speed adjustment member provided near a driver's seat for an operator running and stopping the vehicle and capable of adjusting a running speed, a displacement detection device for detecting a displacement S from a stop operation position of the speed adjustment member, and a drive source controller for controlling a running drive source, the present invention is the compaction vehicle comprising: a calculation device existing between the displacement detection device and the drive source controller, and configured to receive the displacement S and to output the calculated signal I to the drive source controller; a running speed setting switch configured for the operator to operate ON at a desired running speed; a vehicle speed sensor configured to detect a running speed of the vehicle; a control signal memory device provided inside the calculation device and configured to memorize a memorized running speed generate d when the running speed setting switch is operated to ON, wherein in a normal operation the calculation device outputs the signal I to the drive source controller so that the running speed increases or decreases according to an increase or decrease of the displacement S, and wherein when the running speed setting switch is operated to ON, the calculation device maintains the ON state, and the displacement S is not less than a predetermined value, the calculation device uses the running speed from the vehicle speed sensor as feedback information and outputs the signal I to the drive source controller so that the running speed becomes the running speed memorized in the speed memory device.

In accordance with the compaction vehicle it is possible to easily and surely run at a constant speed in a compaction construction. In addition, because the running speed output from the vehicle speed sensor becomes feedback control where the running speed is always reflected on the calculation device as feedback information, a maintaining accuracy of the running speed is improved in maintaining the memorized running speed.

Furthermore, the present invention is a compaction vehicle, wherein the calculation device comprises a displacement memory device configured to memorize the displacement S1 generated when the running speed setting switch is operated to ON, and a comparison device configured to compare the displacement S with the displacement S1 memorized in the displacement memory device when the running speed setting switch is operated to ON and is in the ON state, and wherein when the running speed setting switch is operated to ON, the calculation device maintains the ON state, and the displacement S≧the displacement S1 is satisfied, the calculation device uses the running speed from the vehicle speed sensor as feedback information and outputs the signal I to the drive source controller so that the running speed becomes the running speed memorized in the speed signal memory device.

In accordance with the compaction vehicle, because in an operator an operability of a speed adjustment member is not at all different from the operability in a normal operation until the vehicle reaches a constant speed, there also occurs no problem of a vehicle sudden start and stop possible to be caused due to, for example, the change of the operability.

Furthermore, the present invention is a compaction vehicle, wherein the speed adjustment member is a forward/backward lever configured to stop the vehicle at a neutral position and to move the vehicle forward or backward when respectively tilted forward and backward from the neutral position, and if when the forward/backward lever is positioned at either one of a forward side and a backward side, the running speed setting switch is operated to ON, control for the running drive source after the ON operation is also applied to the other side until the running speed setting switch is operated to OFF.

In accordance with the compaction vehicle it is possible to always move forward or backward at a constant speed in a compaction construction where moving forward and backward are repeated.

BRIEF DESCRIPTION OF THE DRAWINGS

FIGS. 5A to 5C are graphs showing relationships between the displacement S and the signal I after a running speed setting switch is made ON.

BEST MODE FOR CARRYING OUT THE INVENTION

Figure 1:
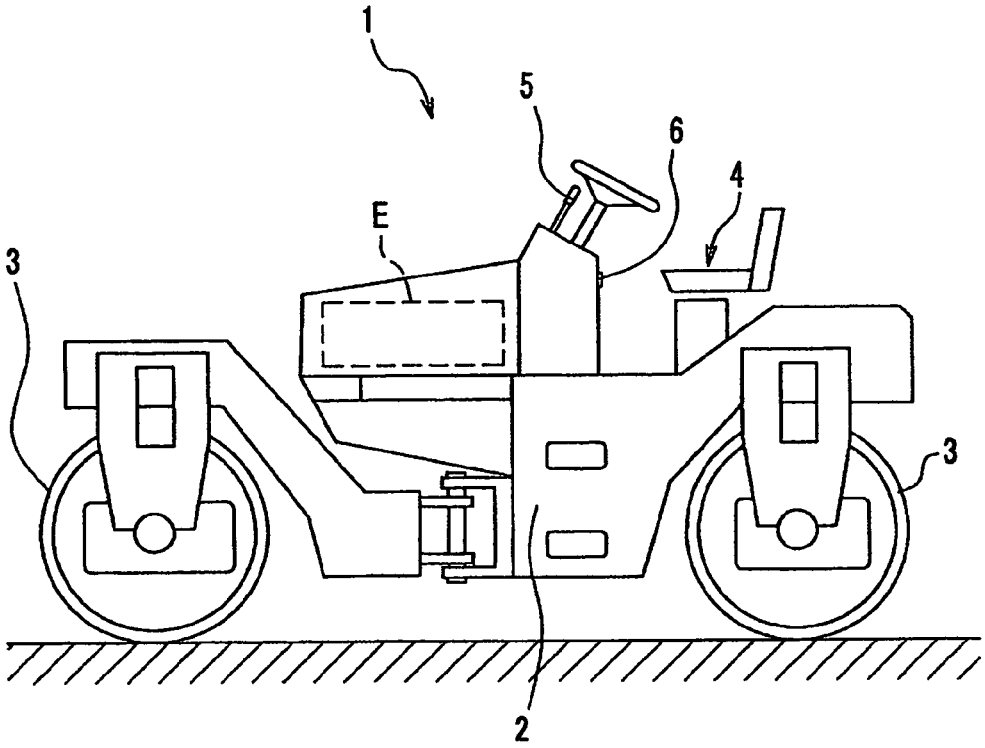
FIG. 1 is a side illustration drawing of a compaction roller of the present invention.

FIG. 1 is a side illustration drawing of a compaction roller that is an example of a compaction vehicle of the present invention. A compaction roller 1 comprises compaction wheels 3 in front and back of a vehicle body 2, and an engine E is mounted on the body 2. A driver's seat 4 is formed at the back of a mounting position of the engine E, and near the seat 4 is provided a forward/backward lever 5 having a function of running or stopping the compaction roller 1 at a neutral position (stop operation position), moving the roller 1 forward when tilted forward from the neutral position, and moving the roller 1 backward when tilted backward from the neutral position.

Figure 2:
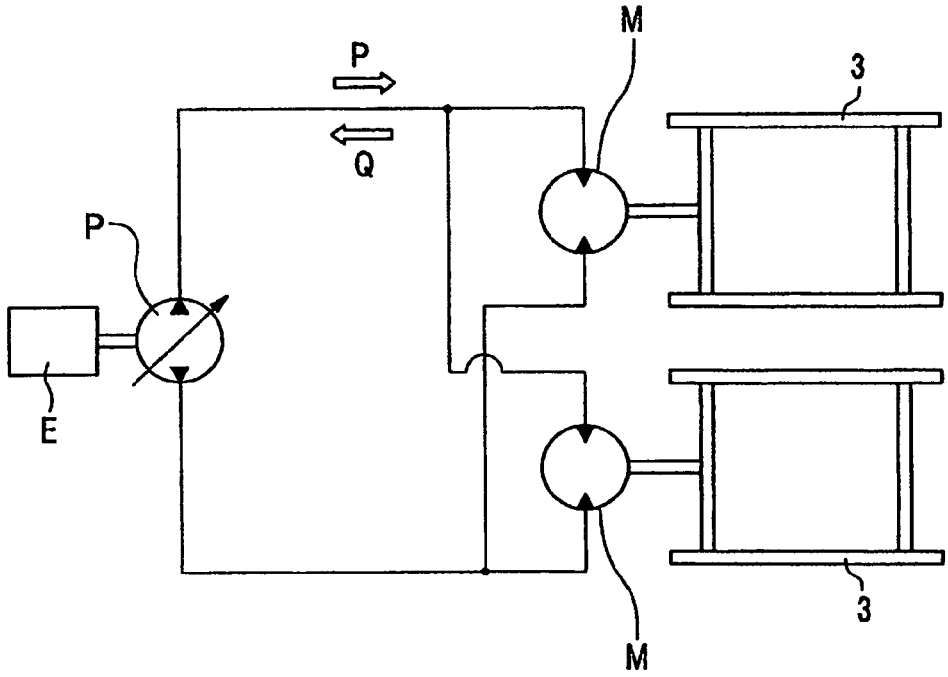
FIG. 2 is a schematic hydraulic circuit drawing related to a running system of a compaction roller.

FIG. 2 is a schematic hydraulic circuit drawing related to a running system of the compaction roller 1. Symbol P is a variable displacement hydraulic pump rotated by the engine E. The hydraulic pump P corresponds to a running drive source 10 (FIG. 4) described later. Symbol M shows a running hydraulic motor that receives supply of hydraulic oil from the hydraulic pump P and rotates, and the motors M are respectively connected to the compaction wheels 3. A hydraulic circuit with respect to the running system is configured as a closed circuit where a pair of the running hydraulic motors M is connected in parallel with the hydraulic pump P.

Thus, for example, if the forward/backward lever 5 is tilted to the forward side from the neutral position, hydraulic oil flows in a P direction in the circuit, thereby the hydraulic motors M rotate in one direction, and the compaction roller 1 moves forward. Furthermore, if the forward/backward lever 5 is tilted to the backward side from the neutral position, hydraulic oil flows in a Q direction in the circuit, thereby the hydraulic motors M rotate in the other direction, and the compaction roller 1 moves backward.

Figure 4:
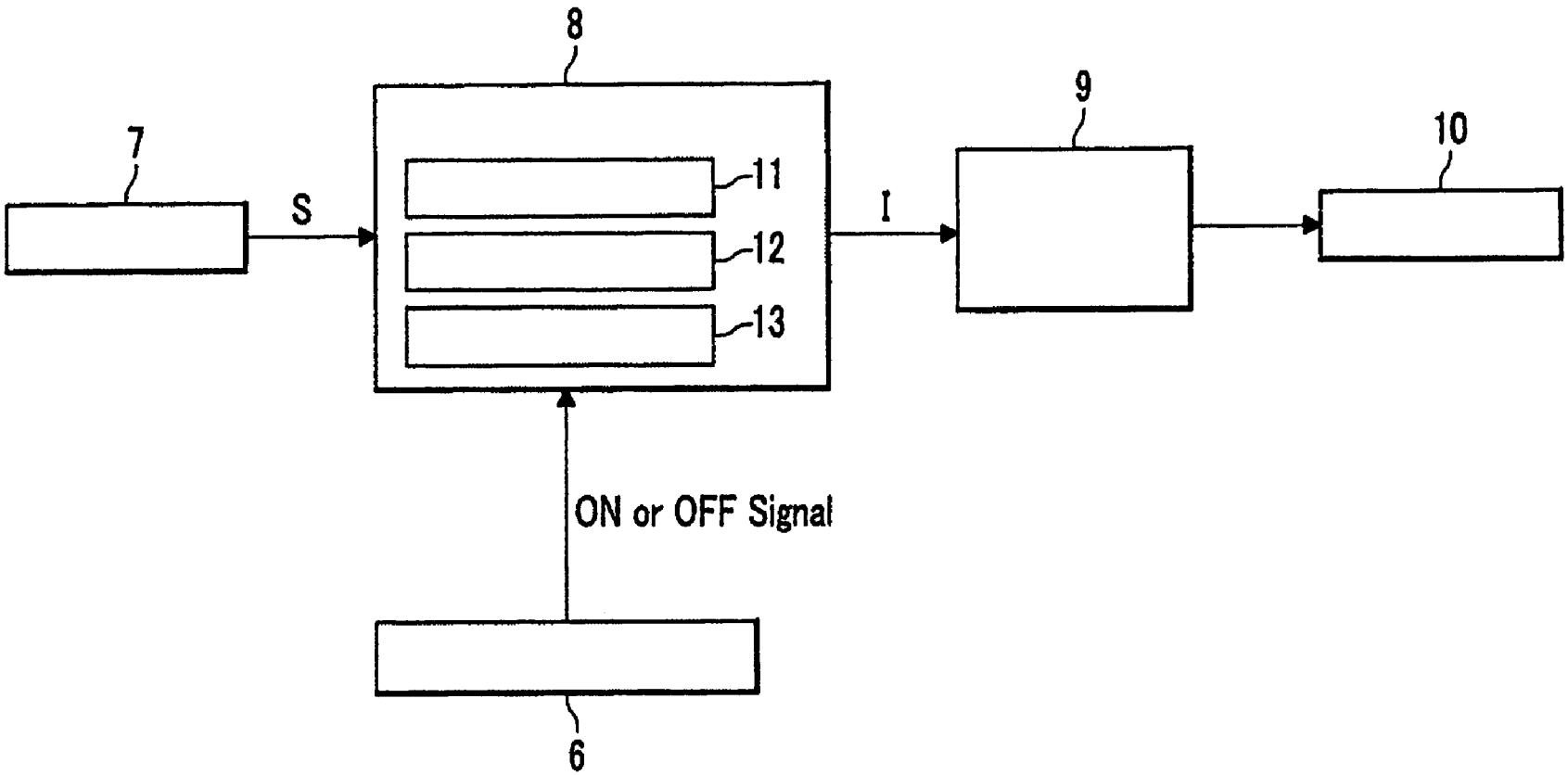
FIG. 4 is a block diagram showing a configuration of the present invention.

FIG. 4 is a block diagram showing a configuration of the present invention. A displacement detection device 7 detects a displacement S (shift amount) from the neutral position of the forward/backward lever 5 shown in FIG. 1. The displacement S of this case is specifically a displacement angle related to the neutral position. A specific example of the displacement detection device 7 is a potentiometer (not shown) for detecting a displacement angle provided around a lower end of the forward/backward lever 5, and a signal with respect to the displacement S of the lever 5 is output to a calculation device 8 from the potentiometer. In the present invention the displacement S with respect to a speed adjustment member is not limited to the case of the displacement angle, and includes such a displacement accompanied by a linear movement. Furthermore, although a specific signal with respect to the displacement S is such an output voltage and electric current, in the present invention a signal with respect to the displacement S is assumed to be simply called "displacement S."

The calculation device 8 is provided between the displacement detection device 7 and a drive source controller 9, calculates and processes the input displacement S, and outputs a signal I processed by the device 8 to the controller 9. The calculation device 8 is configured with such a CPU (Central Processing Unit) and a memory. The signal I is such an output electric current.

The drive source controller 9 is a control part for controlling the running drive source 10 based on the input signal I and, in the present invention, comprises an electric current proportional control valve (not shown). In other words, by a movement of the electric current proportional control valve is adjusted a discharge rate per one rotation of the hydraulic pump P of the running drive source 10. A typical example of the hydraulic pump P is an axial plunger variable displacement pump comprising a servo-cylinder for controlling a slant plate angle. In this case the electric current proportional control valve controls a distribution of hydraulic oil to each oil chamber of the servo-cylinder, resultingly controls the slant plate angle, and controls the discharge rate of the hydraulic pump P.

Figure 3A:
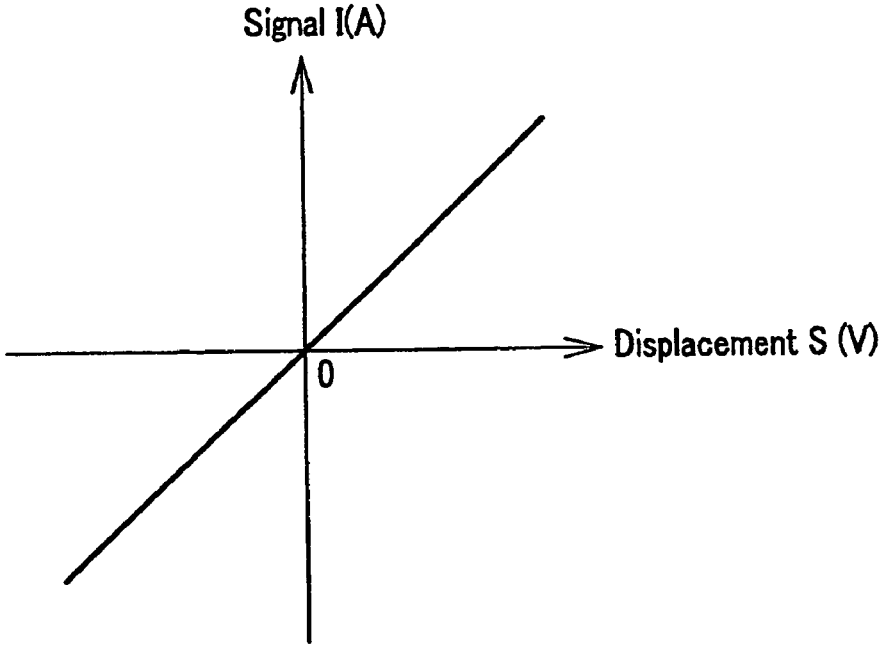
FIG. 3A is a graph showing a relationship between a displacement S and a signal I in a normal operation.
Figure 3B:
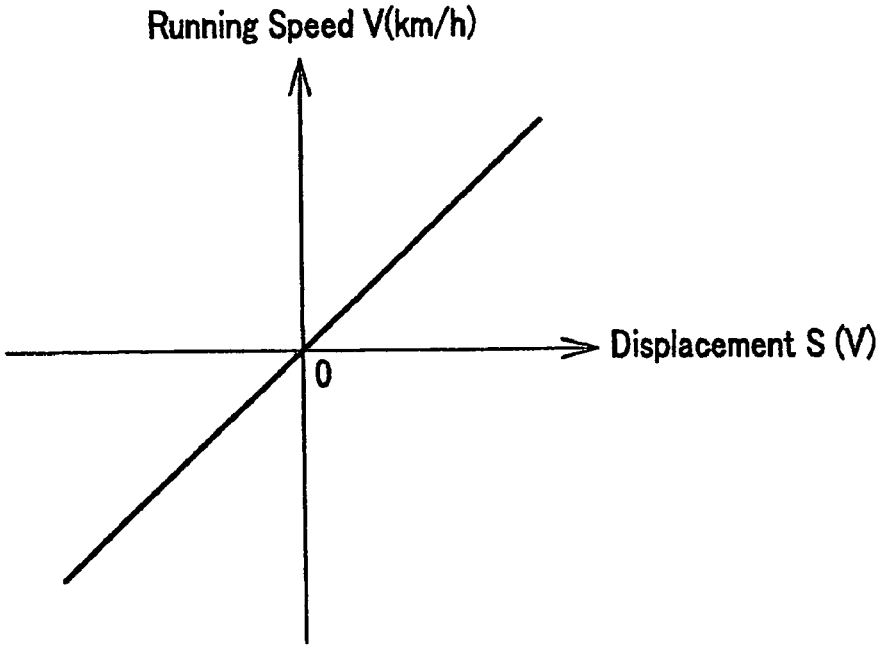
FIG. 3B is a graph showing a relationship between the displacement S and a running speed V in a normal operation.

FIG. 3A is a graph showing a relationship between the displacement S and the signal I, and it is proved from the graph that the signal I is produced as a signal with a value proportional to the displacement S. When the position of the forward/backward lever 5 is forward, the displacement S is plus; when the position of the forward/backward lever 5 is backward, the displacement S is minus. Accordingly, such the signal I is output to the drive source controller 9, the running drive source 10 is controlled, and thereby, as shown in FIG. 3B, the displacement S and the running speed V of the compaction roller 1 become a proportional relationship. In other words, the calculation device 8 outputs the signal I to the drive source controller 9 so that the running speed V increases or decreases according to an increase or decrease of the displacement S.

A running speed setting switch 6 is a switch with which an operator operates ON at a desired running speed and, as shown in FIG. 1, is provided near the driver's seat 4. As a switch structure can be cited, for example, a push button switch that transmits an ON signal if it is once pushed, and is reset (transmits an OFF signal) if it is once again pushed. An ON or OFF signal from the running speed setting switch 6 is output to the calculation device 8.

The calculation device 8 comprises a control signal memory device 11 for memorizing the signal I (this is assumed a signal I1) generated when the running speed setting switch 6 is operated to ON, that is, at a time when the ON signal of the switch 6 is input. In a normal operation (a case of the running speed setting switch 6 being in an OFF state) the calculation device 8 outputs the signal I to the drive source controller 9 so that the running speed V increases or decreases according to an increase or decrease of the displacement S as described before; whereas, when the switch 6 is operated to ON, the device 8 maintains the ON state, and the displacement S is not less than a predetermined value, the device 8 outputs the signal I1 memorized in the control signal memory device 11 to the controller 9 so that the compaction roller 1 runs at a constant speed.

Describing an action of the present invention, if in FIG. 1 an operator tilts the forward/backward lever 5 to the forward side or the backward side by an appropriate tilting angle, and pushes the running speed setting switch 6 when the compaction roller 1 runs a desired running speed, in FIG. 4 an ON signal of the switch 6 is output to the calculation device 8. Receiving the ON signal, the calculation device 8 memorizes by the control signal memory device 11 the signal I1 at a time when the ON signal is input.

Then, as described before, when the displacement S is not less than the predetermined value, the calculation device 8 outputs the signal I1 memorized in the control signal memory device 11 to the drive source controller 9 so that the compaction roller 1 runs at a constant speed. In this case, with respect to setting a predetermined value (that is, a predetermined position of the forward/backward lever 5) of the displacement S can be roughly divided into three. Specifying the displacement S as a displacement S1 (that is, the displacement S of an origin of the signal I1) generated when the running speed setting switch 6 is operated to ON, the setting is divided into three:

"setting the predetermined value larger than the displacement S1,"

"setting the predetermined value smaller than the displacement S1," and

"setting the predetermined value as the displacement S1."

Figure 5A:
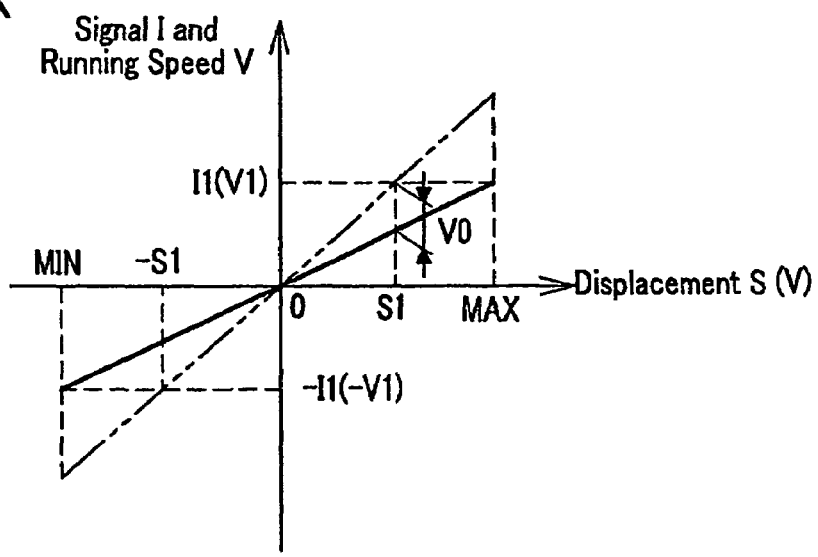
Figure 5B:
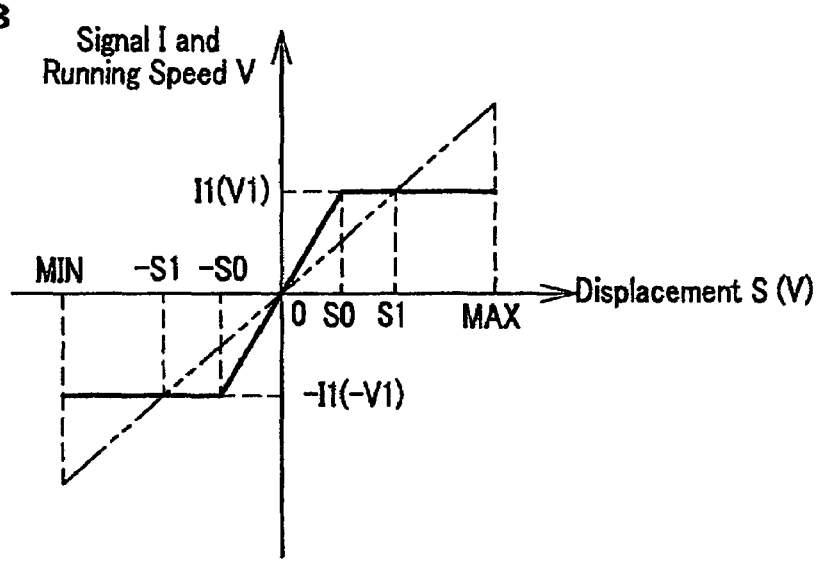
Figure 5C:
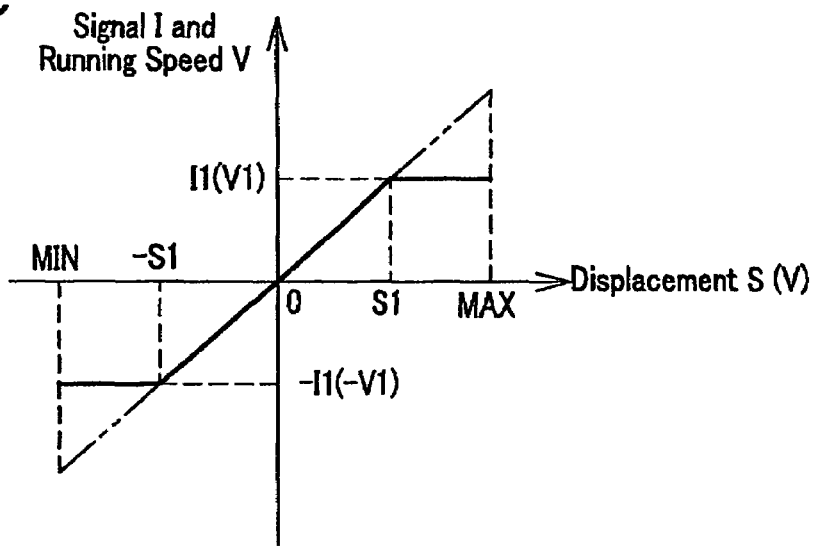

FIGS. 5A to 5C are graphs showing in solid lines relationships between the displacement S and the signal I after the running speed setting switch 6 is operated to ON; horizontal axes are the displacement S and vertical axes are the signal I. A first quadrant of each graph shows a case of the forward/backward lever 5 being tilted to the forward side; a third quadrant of each graph shows a case of the forward/backward lever 5 being tilted to the backward side. Hereafter an action at the first quadrant will be described; however, an action at the third quadrant is similar. In addition, as described in FIGS. 3A and 3B, because the relationship between the displacement S and the running speed V is substantially the same mode as that between the displacement S and the signal I, in the graphs of FIGS. 5A to 5C the running speed V is assumed to be also expressed at the vertical axes. Furthermore, each graph shown in a virtual line of a chain double-dashed line is the graph in a normal operation shown in FIGS. 3A and 3B, that is, conveniently shows a state that the running speed setting switch 6 is not operated to ON.

Firstly, FIG. 5A is a graph explaining the case (1) of "setting the predetermined value larger than the displacement S1" and shows a case that the predetermined value is made a maximum value and minimum value of the displacement S as its one example, that is, a case that the predetermined value is made maximum tilting positions of the forward side and backward side of the forward/backward lever 5. In this example when an operator tilts the forward/backward lever 5 to the maximum tilting position of the forward side or the backward side, the signal I1 memorized in the control signal memory device 11 in FIG. 4 is output to the drive source controller 9. Thus the compaction roller 1 runs at a memorized running speed V1 generated when an operator operates the running speed setting switch 6 to ON. In accordance with this example, there is no need for an operator to adjust and stop the forward/backward lever 5 at a tilting position between the neutral position and the maximum or minimum tilting position, and as a result, the compaction roller 1 always runs at the memorized running speed VI if only tilting the lever 5 to the maximum tilting position in the change of the forward and the backward. In the example of FIG. 5A there is an advantage of being able to perform a subtle adjustment of a speed within a narrow range in a wide tilting range of the forward/backward lever 5. In addition, in the example of FIG. 5A, although when an operator pushes the running speed setting switch 6, there is a case that the running speed V instantaneously lowers by an amount of a speed V0 by changing from the graph shown in the virtual line to that shown in the solid line, it is possible to constantly drive the compaction roller 1 at the memorized running speed V1 by an operator instantly performing such an operation of tilting the forward/backward lever 5 to the maximum tilting position; therefore, there is not much a problem.

Although the example of FIG. 5A is the case that the predetermined value is made the maximum value and minimum value of the displacement S, the case is assumed to satisfy the requirement of "when the displacement S is not less than a predetermined value."

Next, FIG. 5B is a graph explaining the case (2) of "setting the predetermined value smaller than the displacement S1," and the predetermined value is shown as a displacement S0 smaller than the displacement S1. In accordance with this example, when an operator tilts the forward/backward lever 5 to a position of the displacement S0 of the forward side or the backward side, the signal I1 memorized in the control signal memory device 11 in FIG. 4 is output to the drive source controller 9. Thus the compaction roller 1 runs at the memorized running speed V1 generated when an operator operates the running speed setting switch 6 to ON. In other words, in the case of the FIG. 5B different from that of FIG. 5A, the compaction roller 1 runs at the constant running speed V1 when the forward/backward lever 5 is further tilted than when an operator pushes the running speed setting switch 6. In accordance with the example of FIG. 5B, although normally the compaction roller 1 runs at the memorized running speed V1 for the displacement S1, it is possible to reach the running speed V1 at a time when the lever 5 reaches the displacement S0 smaller than the displacement S1 after the running speed setting switch 6 is operated to ON, that is, only by tilting the forward/backward lever 5 less than normal.

Next, FIG. 5C is a graph showing the case (3) of "setting the predetermined value as the displacement S1." In implementing the example of FIG. 5C, in FIG. 4 the calculation device 8 comprises a displacement memory device 12 for memorizing the displacement S1 generated when the running speed setting switch 6 is operated to ON, and a comparison device 13 for comparing the displacement S with the displacement S1 memorized in the displacement memory device 12 when the switch 6 is operated to ON and is in the ON state. When the running speed setting switch 6 is operated to ON, the device 8 maintains the ON state, and there is a relationship of "the displacement S≧the displacement S1" according to the comparison device 13, the signal I1 memorized in the control signal memory device 11 is output to the drive source controller 9 so that the compaction roller 1 runs at a constant speed (memorized running speed V1) in the displacement S1. In accordance with the example of FIG. 5C the compaction roller 1 runs at the memorized running speed V1 from a position of the forward/backward lever 5 positioned when an operator pushes the running speed setting switch 6. Because the example of FIG. 5C is not at all different from the normal graphs of FIGS. 3A and 3B, there is an advantage that the operability of the forward/backward lever 5 is not different from that of a mode in a normal operation.

In addition, in FIGS. 5B and 5C, because an area of the memorized running speed V1 of a constant speed results in starting at a tilting position on the way of the forward/backward lever 5 movement, it suffices as an actual operation method of an operator to only tilt the lever 5 to the maximum tilting position in order to surely run the compaction roller 1 at the running speed V1.

Thus in the compaction roller 1 having the speed adjustment member (forward/backward lever 5) provided near a driver's seat for an operator driving and stopping the roller 1 and capable of adjusting the running speed V, the displacement detection device 7 for detecting the displacement S from the stop operation position of the speed adjustment member (forward/backward lever 5), and the drive source controller 9 (electric current proportional control valve) for controlling the running drive source 10 (hydraulic pump P), if the roller 1 is configured to comprise: the calculation device 8 existing between the device 7 and the controller 9, receiving the displacement S, and outputting the calculated signal I to the controller 9; the running speed setting switch 6 for the operator operating ON at a desired running speed; the control signal memory device 11 provided inside the device 8 and memorizing the signal I1 to the controller 9 when the switch 6 is operated to ON, wherein in a normal operation as shown in FIG. 3B, the device 8 outputs the signal I to the controller 9 so that the running speed V increases or decreases according to the increase or decrease of the displacement S, and wherein when the displacement S is not less than a predetermined value, as shown in FIGS. 5A to 5C, the switch 6 is operated to ON and the device 8 maintains the ON state, the device 8 outputs the signal I1 memorized in the control signal memory device 11 so as to run the roller 1 at the constant speed (memorized running speed V1), it is possible to easily and surely drive the roller 1 at the constant speed in a compaction construction where moving forward and backward are repeated.

Particularly, like the example of FIG. 5C, if the calculation device 8 is configured to comprise the displacement memory device 12 for memorizing the displacement S1 generated when the running speed setting switch 6 is operated to ON, and the comparison device 13 for comparing the displacement S with the displacement S1 memorized in the displacement memory device 12 when the switch 6 is operated to ON and is in the ON state and to output the signal I1 memorized in the control signal memory device 11 to the drive source controller 9 so that the compaction roller 1 runs at the constant speed (memorized running speed V1) in the displacement S1 generated when the running speed setting switch 6 is operated to ON, the device 8 maintains the ON state, and "the displacement S≧the displacement S1" is satisfied, there also occurs no problem of a vehicle sudden start and stop possible to be caused due to, for example, the change of the operability because the operability of the forward/backward lever 5 is not at all different from the operability in a normal operation until the roller 1 reaches the running speed V1.

In addition, in the examples thus described is shown the configuration of the signal I1 being memorized by the control signal memory device 11. However, as shown in FIG. 3A, because the displacement S and the signal I have the proportional relationship, the same result can be substantially obtained even if the signal I1 corresponding to the displacement S1 is memorized. Accordingly, in the present invention the control signal memory device 11 is assumed to include the case of memorizing the displacement S1 generated when the running speed setting switch 6 is operated to ON. In addition, in this case, of course, the calculation device 8 reads the displacement S1 memorized in the control signal memory device I1 and outputs to the drive source controller 9 the signal I1 into which the displacement S1 is calculated.

Figure 6:
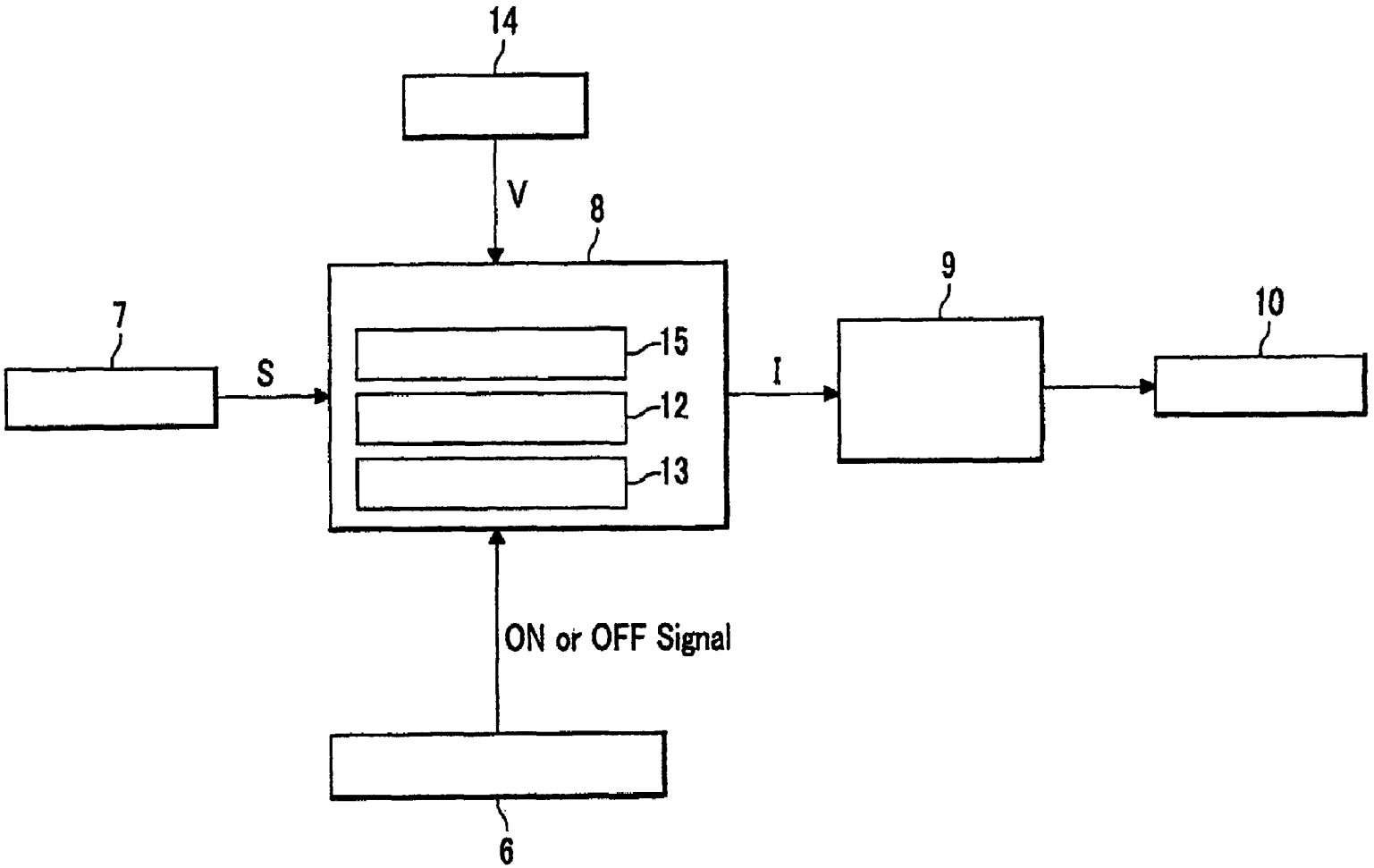
FIG. 6 is a block diagram showing a configuration of another example of the present invention.

Next, referring to FIG. 6, another example will be described. FIG. 6 is a block diagram showing a configuration of another example of the present invention. In the example of FIG. 6 a same symbol will be appended to an element of the same configuration as in the example of FIG. 4, and a description thereof will be omitted. Different points of the example from that shown in FIG. 4 are the following three points:

comprising a vehicle speed sensor 14 for detecting the running speed V of the compaction roller 1;

instead of the control signal memory device 11 of FIG. 4, comprising a speed memory device 15 for memorizing the running speed V1 generated when the running speed setting switch 6 is operated to ON; and in a case of the running speed setting switch 6 being operated to ON, the calculation device 8 maintaining the ON state, and the displacement S being not less than a predetermined value, the device 8 using the running speed V from the vehicle speed sensor 14 as feedback information and outputting the signal I to the drive source controller 9 so that the running speed V becomes the running speed V1 memorized in the speed memory device 15.

A signal with respect to the running speed V output from the vehicle speed sensor 14 is input to the calculation device 8. Although a specific signal with respect to the running speed V is such an output voltage and electric current, it is assumed in the present invention that the signal with respect to the running speed V is simply called "running speed V."

Describing an action of the example, if in FIG. 1 an operator tilts the forward/backward lever 5 to the forward side or the backward side by an appropriate tilting angle, and pushes the running speed setting switch 6 when the compaction roller 1 becomes a desired running speed, in FIG. 6 an ON signal of the switch 6 is output to the calculation device 8. Receiving the ON signal, the calculation device 8 memorizes the running speed V1 at a time when the ON signal is input, by the speed signal memory device 15.

Then when the displacement S is not less than a predetermined value, the calculation device 8 uses the running speed V as feedback information and outputs the signal I to the drive source controller 9 so that the running speed V becomes the running speed V1 memorized in the speed memory device 15. Also in this case, with respect to setting a predetermined value (that is, a predetermined position of the forward/backward lever 5) of the displacement S can be roughly divided into three:

"setting the predetermined value larger than the displacement S1,"

"setting the predetermined value smaller than the displacement S1," and

"setting the predetermined value as the displacement S1."

The following will be described, using FIGS. 5A to 5C. Firstly, FIG. 5A is the graph showing the case (1) of "setting the predetermined value larger than the displacement S1" and shows the case that the predetermined value is made the maximum value and minimum value of the displacement S as its one example, that is, the case that the predetermined value is made the maximum tilting positions of the forward side and backward side of the forward/backward lever 5. In this example when an operator tilts the forward/backward lever 5 to the maximum tilting position of the forward side or the backward side, in FIG. 6 the calculation device 8 uses the running speed V from the vehicle speed sensor 14 as feedback information and outputs the signal I to the drive source controller 9 so that the running speed V becomes the running speed V1 memorized in the speed memory device 15. Thus the compaction roller 1 runs at the memorized running speed V1 generated when he or she operates the running speed setting switch 6 to ON. In addition, an operation method and effect for an operator are similar to those of the case in the configuration of FIG. 4. In other words, there is no need for an operator to adjust and stop the forward/backward lever 5 at a tilting position on the way of the forward side or the backward side, and the compaction roller 1 results in always running at the memorized running speed V1 only if tilting the lever 5 to the maximum tilting position in the change of the forward and the backward. In the example there is an advantage of being able to perform the subtle adjustment of a speed within a narrow range in the wide tilting range of the forward/backward lever 5.

Next, FIG. 5B is the graph showing the case (2) of "setting the predetermined value smaller than the displacement S1," and the predetermined value is shown as the displacement S0 smaller than the displacement S. In accordance with this example, when an operator tilts the forward/backward lever 5 to positions of the displacement S0 of the forward side and the backward side, in FIG. 6 the calculation device 8 uses the running speed V from the vehicle speed sensor 14 as feedback information and outputs the signal I to the drive source controller 9 so that the running speed V becomes the running speed V1 memorized in the speed memory device 15. Thus the compaction roller 1 runs at the memorized running speed V1 generated when an operator operates the running speed setting switch 6 to ON. In addition, an operation method and effect for an operator are similar to those of the case in the configuration of FIG. 4. In other words, in the example the compaction roller 1 constantly runs at the memorized running speed V1 after a position of the forward/backward lever 5 positioned when an operator pushes the running speed setting switch 6. In accordance with the example of FIG. 5B, although normally the compaction roller 1 runs at the memorized running speed V1 in the displacement S1, it is possible to reach the running speed V1 at a time when the lever 5 reaches the displacement S0 smaller than the displacement S1 after the running speed setting switch 6 is operated to ON, that is, only by tilting the forward/backward lever 5 less than normal.

Next, FIG. 5C is the graph showing the case (3) of "setting the predetermined value as the displacement S1." In implementing the example of FIG. 5C, in FIG. 6 the calculation device 8 comprises the displacement memory device 12 for memorizing the displacement S1 generated when the running speed setting switch 6 is operated to ON, and the comparison device 13 for comparing the displacement S with the displacement S1 memorized in the displacement memory device 12 when the switch 6 is operated to ON and is in the ON state. When the running speed setting switch 6 is operated to ON, the calculation device 8 maintains the ON state, and there is a relationship of "the displacement S≧the displacement S1" according to the comparison device 13, the calculation device 8 uses the running speed V from the vehicle speed sensor 14 as feedback information and outputs the signal I to the drive source controller 9 so that the running speed V becomes the running speed V1 memorized in the speed memory device 15. An operation method and effect for an operator are similar to those of the case in the configuration of FIG. 4. In other words, the compaction roller 1 runs at the memorized running speed V1 from the position of the forward/backward lever 5 positioned when an operator pushes the running speed setting switch 6. Then because the example of FIG. 5C is not at all different from the normal graphs of FIGS. 3A and 3B, there is an advantage that the operability of the forward/backward lever 5 is not different from that of the mode in a normal operation.

Thus in the compaction roller 1 having the speed adjustment member (forward/backward lever 5) provided near a driver's seat for an operator running and stopping the roller 1 and capable of adjusting the running speed V, the displacement detection device 7 for detecting the displacement S from the stop operation position of the speed adjustment member (forward/backward lever 5), and the drive source controller 9 (electric current proportional control valve) for controlling the running drive source 10 (hydraulic pump P), if the roller 1 is configured to comprise: the calculation device 8 existing between the device 7 and the drive source controller 9, receiving the displacement S, and outputting the calculated signal I to the drive source controller 9; the running speed setting switch 6 for the operator operating ON at a desired running speed; the vehicle speed sensor 14 for detecting the running speed V of the compaction roller 1; and the speed memory device 15 provided inside the device 8 and memorizing the running speed V1 generated when the switch 6 is operated to ON, wherein in a normal operation as shown in FIG. 3B, the device 8 outputs the signal I to the controller 9 so that the running speed V increases or decreases according to the increase or decrease of the displacement S, and wherein when the switch 6 is operated to ON, the device 8 maintains the ON state, and the displacement S is not less than a predetermined value, as shown in FIGS. 5A to 5C, the device 8 uses the running speed V from the vehicle speed sensor 14 as feedback information and outputs the signal I to the drive source controller 9 so that the running speed V becomes the running speed V1 memorized in the speed memory device 15, it is possible to easily and surely run the roller 1 at the running speed V1 in a compaction construction where moving forward and backward are repeated. Because the configuration of FIG. 6 is feedback control where the running speed V output from the vehicle speed sensor 14 is always reflected on the calculation device 8 as feedback information, a maintaining accuracy of the running speed V1 is improved.

Also in the configuration of FIG. 6, like the example of FIG. 5C, if the calculation device 8 is configured to comprise the displacement memory device 12 for memorizing the displacement S1 generated when the running speed setting switch 6 is operated to ON, and the comparison device 13 for comparing the displacement S with the displacement S1 memorized in the displacement memory device 12 when the switch 6 is operated to ON and is in the ON state, to use the running speed V from the vehicle speed sensor 14 as feedback information, and to output the signal I to the drive source controller 9 so that the running speed V becomes the running speed V1 memorized in the speed memory device 15 when the running speed setting switch 6 is operated to ON, the device 8 maintains the ON state, and there is a relationship of "the displacement S≧the displacement S1", there also occurs no problem of a vehicle sudden start and stop possible to be caused due to, for example, the change of the operability because the operability of the forward/backward lever 5 is not at all different from the operability in a normal operation until the compaction roller 1 reaches the running speed V1.

Thus the best modes of the present invention have been described. Any action with respect to the described control is applied to both of the forward and backward sides of the forward/backward lever 5. In other words, if when the forward/backward lever 5 is positioned at either one side of the forward and backward sides, the running speed setting switch 6 is operated to ON, control for the running drive source 10 after the ON operation is applied to the other side until the switch 6 is operated to OFF. Thus it is possible to always move the compaction roller 1 forward and backward in a compaction construction accompanied with moving forward and backward.

Furthermore, timing when the calculation device 8 invokes the configuration of "outputting the signal I1 memorized in the control signal memory device to the drive source controller so as to run the compaction roller 1 at a constant speed in a case of a running speed setting switch being operated to ON, the device 8 maintaining the ON state, and the displacement S being not less than a predetermined value," or the configuration of "using the running speed V from the vehicle speed sensor as feedback information and outputting the signal I to the drive source controller so that the running speed V becomes the running speed V1 memorized in the speed memory device in a case of a running speed setting switch being operated to ON, the device 8 maintaining the ON state, and the displacement S being not less than a predetermined value" is not limited to the case of timing when an operator operates the running speed setting switch 6 to ON. For example, even timing on and after an operator operating the running speed setting switch 6 to ON and then returning the forward/backward lever 5 once to the neutral position may be included as the invocation timing in the present invention.

Furthermore, even if the speed adjustment member is a foot pedal, wherein when a foot is apart, the vehicle becomes a running stop and a running speed increases as the pedal is pushed down, the present invention is applicable thereto. Other than this, the present invention is not limited to the matters drawn and described in the drawings, and is appropriately changeable in design within the spirit and scope of the invention.

What is claimed is:

1. A compaction vehicle having a speed adjustment member provided near a driver's seat for an operator running and stopping the vehicle, and configured to adjust a running speed of the vehicle, a displacement detection device configured to detect a displacement (S) of the speed adjustment member from a stop operation position of the speed adjustment member, a running drive source which runs the vehicle; and a drive source controller configured to control the running drive source, the vehicle comprising:

a calculation device existing between the displacement detection device and the drive source controller, and configured to receive the displacement (S) and to output a calculated signal (I) to the drive source controller;

a running speed setting switch configured for the operator to operate ON at a desired running speed;

a vehicle speed sensor configured to detect a running speed (V) of the vehicle;

a control signal memory device provided inside the calculation device and configured to memorize a running speed (V1) generated when the running speed setting switch is operated to ON, wherein in a normal operation when the running speed setting switch has not been operated to ON, the calculation device outputs the calculated signal (I) over a whole range of the displacement (S) to the drive source controller so that the running speed (V) increases or decreases according to an increase or decrease in the displacement (S) of the speed adjustment member, wherein when the running speed setting switch is operated to ON, the ON state of running speed setting switch is maintained, and the displacement (S) is not less than a predetermined value, the calculation device uses the running speed (V) from the vehicle speed sensor as a feedback information and outputs the signal (I) to the drive source controller so that the running speed (V) becomes the running speed (V1) memorized in the control signal memory device; and wherein when the running speed setting switch is operated to ON, the ON state of running speed setting switch is maintained, and the displacement (S) is less than the predetermined value, the calculation device outputs the signal (I) to the drive source controller, making the memorized running speed (V1) as a maximum speed, so as to increase or decrease the running speed (V), depending on the increase and decrease of the displacement.

2. The compaction vehicle according to claim 1, wherein the calculation device comprises a displacement memory device configured to memorize a displacement (S1) generated when the running speed setting switch is operated to ON, and a comparison device configured to compare the displacement (S) with the displacement (S1) memorized in the displacement memory device when the running speed setting switch is operated to ON and is in the ON state, wherein when the running speed setting switch is operated to ON, ON state of running speed setting switch is maintained, and the displacement (S) ≧ the displacement (S1) is satisfied, the calculation device uses the running speed from the vehicle speed sensor as a feedback information and outputs the signal (I) to the drive source controller so that the running speed becomes the running speed (V1) memorized in the control signal memory device.

3. The compaction vehicle according to claim 1, wherein the speed adjustment member is a forward/backward lever configured to stop the vehicle at a neutral position and to move the vehicle forward or backward when respectively tilted towards a forward side and a backward side from the neutral position, and wherein when the forward/backward lever is positioned at either one of said forward side and said backward side, if the running speed setting switch is operated to said ON position, the feedback control for the running drive source after the ON operation is also applied to the other one of the forward side and the backward side until the running speed setting switch is operated to OFF.

4. The compaction vehicle according to claim 2, wherein the speed adjustment member is a forward/backward lever configured to stop the vehicle at a neutral position and to move the vehicle forward or backward when respectively tilted towards a forward side and a backward side from the neutral position, and wherein when the forward/backward lever is positioned at either one of said forward side and said backward side, if the running speed setting switch is operated to said ON position, the feedback control for the running drive source after the ON operation is also applied to the other one of the forward side and the backward side until the running speed setting switch is operated to OFF.

5. The compaction vehicle according to claim 1, wherein the speed adjustment member is a forward/backward lever configured to stop the vehicle at a neutral position and to move the vehicle forward or backward, and wherein a start timing when the calculation device outputs the signal (I) to the drive source controller so that the running speed (V) becomes the memorized running speed (V1) is after the operator operates the running speed setting switch to ON and once returns the forward/backward lever to the neutral position.

6. The compaction vehicle according to claim 2, wherein the speed adjustment member is a forward/backward lever configured to stop the vehicle at a neutral position and to move the vehicle forward or backward, and wherein a start timing when the calculation device outputs the signal (I) to the drive source controller so that the running speed (V) becomes the memorized running speed (V1) is after the operator operates the running speed setting switch to ON and once returns the forward/backward lever to the neutral position.

7. The compaction vehicle according to claim 3, wherein the speed adjustment member is a forward/backward lever configured to stop the vehicle at a neutral position and to move the vehicle forward or backward, and wherein a staff timing when the calculation device outputs the signal (I) to the drive source controller so that the running speed (V) becomes the memorized running speed (V1) is after the operator operates the running speed setting switch to ON and once returns the forward/backward lever to the neutral position.

8. The compaction vehicle according to claim 4, wherein the speed adjustment member is a forward/backward lever configured to stop the vehicle at a neutral position and to move the vehicle forward or backward, and wherein a staff timing when the calculation device outputs the signal (I) to the drive source controller so that the running speed (V) becomes the memorized running speed (V1) is after the operator operates the running speed setting switch to ON and once returns the forward/backward lever to the neutral position.

9. The compaction vehicle according to claim 1, wherein the speed adjustment member is a forward/backward lever configured to stop the vehicle when the lever is in a neutral position thereof, and to move the vehicle forward or backward when the lever is respectively tilted towards a forward side and a backward side from the neutral position.

10. The compaction vehicle according to claim 1, wherein when the running speed setting switch is operated to ON, the ON state of running speed setting switch is maintained, and the displacement (S) is not less than a predetermined value, the calculation device uses the running speed (V) from the vehicle speed sensor as a feedback information and outputs the signal (I) to the drive source controller so that the running speed (V) becomes the running speed (V1) memorized in the control signal memory device and the vehicle runs at the running speed (V1) when the vehicle is moving in both forward and backward directions.

* * * * *

UNITED STATES PATENT AND TRADEMARK OFFICE

CERTIFICATE OF CORRECTION

PATENT NO. : 7,689,342 B2
APPLICATION NO. : 11/499914
DATED : March 30, 2010
INVENTOR(S) : Suzuki et al.

It is certified that error appears in the above-identified patent and that said Letters Patent is hereby corrected as shown below:

Title page:

Item (73), "Assignee", between "Industries" and "Ltd.", insert --,--.

Under item (56), after "*Assistant Examiner*—", change "Chuong P" to --Chuong P.--.

Column 1:

Line 19, change "a important" to --an important--.

Column 2:

Line 50, change "generate d" to --generated--.

Column 4:

Line 12, change "receives supply of" to --receives a supply of--.

Column 5:

Line 5, change "Accordingly, such the" to --Accordingly, when the--.

Column 6:

Lines 10-13, change

"Furthermore, each graph shown in a virtual line of a chain double-dashed line is the graph in a normal operation shown in FIGS. 3A and 3B, that is, conveniently shows a state that the running speed"

to

--Furthermore, each graph of FIGS. 5A to 5C also shows a chain double-dashed virtual line representing the graph of a normal operation shown in FIGS. 3A and 3B, that is, conveniently shows a state where the running speed--.

Line 47, change "not much a problem" to --not much of a problem--.

Line 64, change "case of the FIG. 5B different" to --case of FIG. 5B, different--.

Signed and Sealed this
Fourteenth Day of June, 2011

David J. Kappos

David J. Kappos
*Director of the United States Patent and Trademark Office*

Column 8:

Lines 31-32, change "memory device I1" to --memory device 11--.

Lines 39-40, change

"Different points of the example from that shown in FIG. 4 are the following three points:"

to

--The example shown in FIG. 6 differs from that shown in FIG. 4 in the following three points:--.

Column 9:

Line 11, change "displacement S can be" to --displacement S, the setting can be--.

Column 11:

Line 1, change "a maintain-" to --maintain- --.

Column 13:

Line 32, change "speed (V1) is after" to --speed (V1) occurs after--.

Line 33, change "and once returns" to --and returns--.

Line 34, change "lever to the" to --lever once to the--.

Column 14:

Line 1, change "speed (V1) is after" to --speed (V1) occurs after--.

Line 2, change "and once returns" to --and returns--.

Line 3, change "lever to the" to --lever once to the--.

Line 8, change "a staff timing" to --a start timing--.

Line 11, change "speed (V1) is after" to --speed (V1) occurs after--.

Line 12, change "and once returns" to --and returns--.

Line 13, change "lever to the" to --lever once to the--.

Line 18, change "a staff timing" to --a start timing--.

Line 21, change "speed (V1) is after" to --speed (V1) occurs after--.

Line 22, change "and once returns" to --and returns--.

Line 23, change "lever to the" to --lever once to the--.